US009202446B2

(12) United States Patent
Gauthier

(10) Patent No.: US 9,202,446 B2
(45) Date of Patent: Dec. 1, 2015

(54) STRINGED INSTRUMENT PLECTRUM COVER

(71) Applicant: David Gauthier, Surrey, CA (US)

(72) Inventor: David Gauthier, Surrey, CA (US)

( * ) Notice: Subject to any disclaimer, the term of this patent is extended or adjusted under 35 U.S.C. 154(b) by 0 days.

(21) Appl. No.: 14/146,321

(22) Filed: Jan. 2, 2014

(65) Prior Publication Data

US 2014/0202309 A1 Jul. 24, 2014

Related U.S. Application Data

(60) Provisional application No. 61/755,602, filed on Jan. 23, 2013.

(51) Int. Cl.
*G10D 3/16* (2006.01)

(52) U.S. Cl.
CPC ..... *G10D 3/163* (2013.01)

(58) Field of Classification Search
CPC ..... G10D 3/163; G10D 1/005
USPC ..... 84/320–322
See application file for complete search history.

(56) References Cited

U.S. PATENT DOCUMENTS

| | | | | |
|---|---|---|---|---|
| 655,959 | A | 8/1900 | Cochrane | |
| 1,184,561 | A | 5/1916 | Napoletano | |
| 1,263,740 | A | 4/1918 | Burdwise | |
| 4,993,302 | A | 2/1991 | Jonathan | |
| 5,271,308 | A | 12/1993 | Balog | |
| 7,145,066 | B1 | 12/2006 | Moreland | |
| 7,626,103 | B1 * | 12/2009 | Phillips | 84/320 |
| 2011/0179938 | A1 * | 7/2011 | Smith | 84/322 |

* cited by examiner

*Primary Examiner* — Kimberly Lockett
(74) *Attorney, Agent, or Firm* — Daniel Boudwin; Global Intellectual Property Agency LLC

(57) ABSTRACT

A stringed instrument plectrum cover that includes a formed structure having a conformal shape adapted to match the tear-drop shape of an instrument pick. The cover comprises a thickened member having an open interior. The plucking end of the pick is exposed while the body of the pick is retained within the thickened member, whereby the member increases the thickness of the pick and improves purchase thereof. The surface of the cover includes decorative features such as phosphorescent decals and designs thereon for personalization and for identification of the pick in low light. The pick is inserted through the open end of the thickened member, whereby the pick is supported within a channel in the padded member while its plucking end and its body section is exposed.

11 Claims, 2 Drawing Sheets

STRINGED INSTRUMENT PLECTRUM COVER

CROSS REFERENCE TO RELATED APPLICATION

This application claims the benefit of U.S. Provisional Application No. 61/755,602 filed on Jan. 23, 2013, entitled "Slick Picks." The above identified patent application is herein incorporated by reference in its entirety to provide continuity of disclosure.

BACKGROUND OF THE INVENTION

Field of the Invention

The present invention relates to musical instruments and accessories therefor. More specifically, the present invention relates to a plectrum cover that increases grip thereof and further provides a decorative addition during performances.

Plectrums, or picks, are handheld plucking elements that are commonly utilized with string instruments. These elements are generally flatted members having a widened grip area and a narrow, substantially pointed distal end that allows a musician to grip the one end of the device while strumming or plucking the strings of a musical instrument along the opposing end. It is common for these elements to be deployed with guitar instruments, mandolins, and other stringed instruments that are plucked or strummed to create musical notes.

A frequent issue with picks is handling these items despite their small size and their planar shape, which makes for difficult purchase over long periods of time, and further to mishandling thereof during performances. Most often, a musician will have several picks on hand that are readily accessible for exchanging a dropped or broken example for a replacement during a performance. Many performers complain of that they lose feeling in their fingertips because of the inherent thinness of the pick and the force exerted thereon by the user. The numbness and the inherent shape of the pick causes very specific handling problems, including rotation of the pick while in the grip of the user, loss of purchase of the pick during a performance, and further a reduced capacity to handle the pick for long performances when close control of the pick is required to properly play each note.

These handling issues can detract from the performance, and thus the quality of the music. The frequent replacement of picks during of a performance is also annoying and a cause of frustration for a performer, not to mention an unnecessary expense. Therefore, a new pick or improvement thereof is desired to address these known handling problems in the art of string instruments.

The present invention is an improvement to instrument picks that aims to reduce handling problems therewith, wherein a thickened cover is slid over the body of the pick to prevent numbness in the user's fingers and to prevent mishandling thereof during a performance. The device is a thickened member having a receiving slot adapted to accept the plucking end of most common guitar picks and support the widened body thereof while the pick distal end (plucking end) is left exposed. The padded cover allows for improved purchase over the pick element, prevents handling mishaps and prevents over-gripping the pick that otherwise leads to finger numbness. Also disclosed is an exterior surface of the cover that allows for different designs, colors, and phosphorescent features for added flare during a performance and for more readily identifying or locating a pick in low light conditions, where finding a lost pick may otherwise be difficult during a performance.

DESCRIPTION OF THE PRIOR ART

Devices have been disclosed in the prior art that relate to guitar picks and plectra devices. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

One such device is U.S. Pat. No. 655,959 to Cochrane, which discloses a mandolin pick holder that comprises a hollow cylinder having closed ends and a roughened surface to provide grip for the user. A longitudinal slot is disposed on the cylinder for insertion of the pick therethrough. Extending from the cylinder is a shank being substantially equal in width to the widest end of the pick and forming a cover thereover. While disclosing a cover for a pick, the Cochrane device fails to disclose the same structure as that of the present invention.

Another device U.S. Pat. No. 7,145,066 to Moreland, which discloses stringed instrument pick grip that is removable and repeatably usable, wherein the device comprises an adhesable surface that is adapted to be placed onto the pick surface for increase friction with a user's fingers. The surface follows the contours of a tear-drop shaped pick and adheres by way of cohesion or surface tension. While providing a solution to most string instrument picks and their inherently slick surface, the Moreland device fails to provide a structure that accepts that pick into its interior and thickens the pick for increased purchase or grip thereof.

U.S. Pat. No. 1,263,740 to Burdwise discloses a pick for a stringed instrument in which a wire is secured around the pick and about the widened end thereof for improved grip. The wire includes a loop that rests against the pick and about the location in which the fingers rest, while the extremities of the wire are bent around the side edges of the pick. This construction of a pick grip utilizes a bendable wire that gives texture to the pick, as opposed to providing a sleeve that increases the grip area and the thickness of the pick.

Finally, U.S. Pat. No. 1,184,561 to Napoletano discloses a plectrum cover for musical instruments in which a cover having a channel accepts a music pick therethrough. The channel extends from the narrow end of the device towards the wider portion and terminates before the rear of the cover. A recess in the cover provides for placement of the fleshy portion of a musician's fingers, wherein the musician can better grasp the pick using the edges of the recess and the thickened holder. While disclosing a device with a similar intent as that of the present invention, the Napoletano device includes a structure that accepts the widened portion of the pick first and stretches to accommodate the pick body.

The present invention discloses a pick cover that includes a narrow end portion, a widened rear portion, and a channel extending through the device from one end to another to accept the pick therethrough. The pick is inserted by its narrow end first and pressed into the cover through its back end. The progressively widening edges of the pick bear against the narrowing channel and the pick is secured therein, whereafter a user can grip the assembly while playing a musical instrument. It is submitted that the present invention is substantially divergent in design elements from the prior art, and consequently it is clear that there is a need in the art for an improvement to existing stringed instrument pick cover devices. In this regard the instant invention substantially fulfills these needs.

SUMMARY OF THE INVENTION

In view of the foregoing disadvantages inherent in the known types of stringed instrument pick cover devices now present in the prior art, the present invention provides a new pick cover that can be utilized for providing convenience for the user when increasing the gripping area of the pick and thickening its structure for improved handling during use.

It is therefore an object of the present invention to provide a new and improved stringed instrument pick cover that has all of the advantages of the prior art and none of the disadvantages.

It is another object of the present invention to provide a stringed instrument pick cover that increases the gripping area and comfort of the pick, thereby preventing finger numbness during use and reducing the likelihood of mishandling the pick.

Another object of the present invention is to provide a stringed instrument pick cover that includes a thickened member having an open interior that provides access to the pick surfaces, and an elongated channel the secures the pick within the member.

Yet another object of the present invention is to provide a stringed instrument pick cover that includes phosphorescent designs along its outer surface for decorative purposes and for locating the pick in low light environments.

Another object of the present invention is to provide a stringed instrument pick cover that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
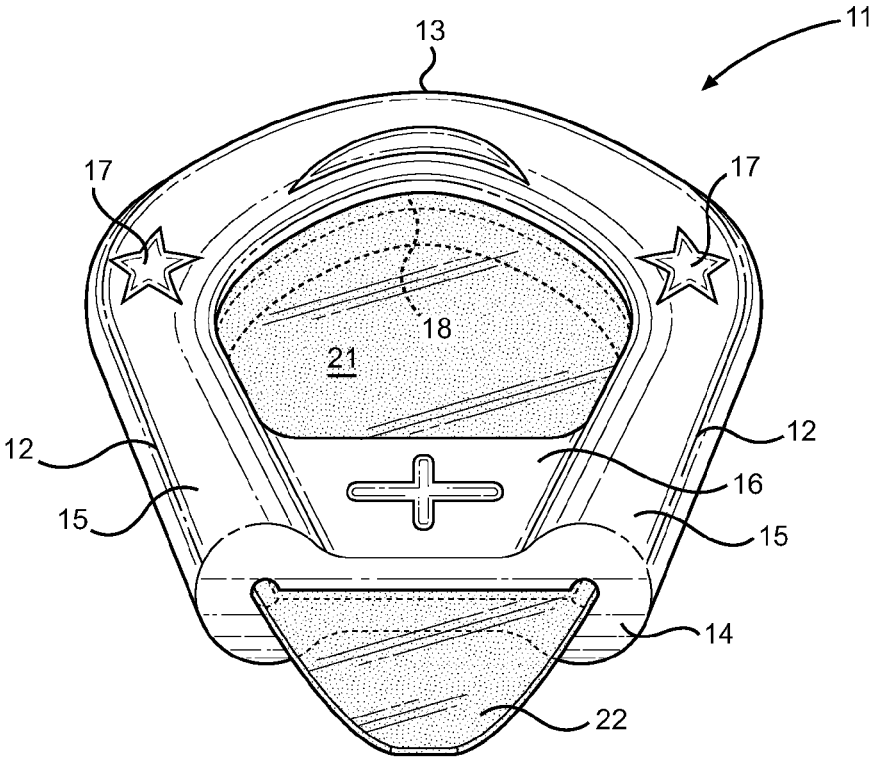
FIG. 1 shows a frontal perspective view of the pick cover of the present invention in a working state.

Reference is made herein to the attached drawings. Like reference numerals are used throughout the drawings to depict like or similar elements of the stringed instrument pick cover device. For the purposes of presenting a brief and clear description of the present invention, the preferred embodiment will be discussed as used for improving grip and reducing handling issues of a stringed instrument pick. The figures are intended for representative purposes only and should not be considered to be limiting in any respect.

Referring now to FIG. 1, there is shown a frontal perspective view of the pick cover device of the present invention. The cover 11 comprises a thickened member having a wide base 13, tapering sides 12, and a narrow distal end 14. Through the interior of the cover 11 is an elongated receiving channel 18 adapted to receive the tear-drop shaped instrument pick therethrough. The channel 18 includes a progressively narrowing width to accommodate the shape of the pick, wherein the plucking end 22 of the pick is inserted into the channel 18 opening along the base 13 of the cover. Once inserted, the narrow plucking end 22 of the pick is exposed through a slot opening along the distal end 14 of the cover, while its upper and lower body surface 21 are also exposed through an aperture in the cover.

The thickened member preferably includes thickened side portions 15 that are cylindrical in shape. These side portions 15 increase the gripping area for the user and provide a thickness that acts as a finger cushion when the user is pressing the pick between his or her fingers. This increased area and cushioned thickness improve the overall grip of the pick and reduce finger numbness over prolonged use. The side portions 15 are connected via a bridge 16 along the distal end 14 of the cover, while the side portions 15 form together along the back 13 of the cover. The interior of the cover is left open for direct access to the pick body 21 when handling, wherein the user's fingers can bear against the pick surfaces 21 in between the thickened side portions 15.

Disposed along the surfaces of the thickened member may be decorative designs, including phosphorescent decals 17 or coatings that allow the pick to be visible in low light. These designs improve the aesthetics of the pick and add a level of flare during a presentation, wherein the pick may be visible in the musician's hand during a performance. The layout and shape of the designs may take on many different forms, while further the entire outer surface of the thickened member may be phosphorescent.

Figure 2:
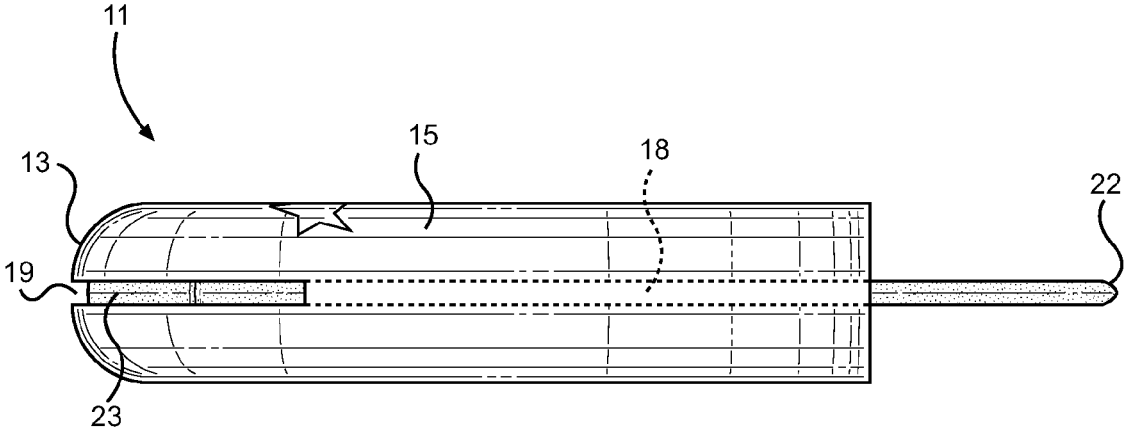
FIG. 2 shows a side view of the pick cover supporting a stringed instrument pick within its interior channel.

Referring now to FIG. 2, there is shown a side view of the pick cover of the present invention in a working state, supporting a pick within its interior channel 18. This figure illustrates the thickness of the side portions 15 with respect to the pick thickness, as wells as the receiving channel 19 disposed along the back end 13 of the thickened member 11. The receiving slot 19 is an elongated aperture that accepts the instrument pick and allows the pick to be inserted into the interior channel 18. The plucking end 22 of the pick is inserted through the slot 19 and into the interior of the cover until the widened end 23 of the pick is secured therein and surrounded by the cover.

Figure 3:
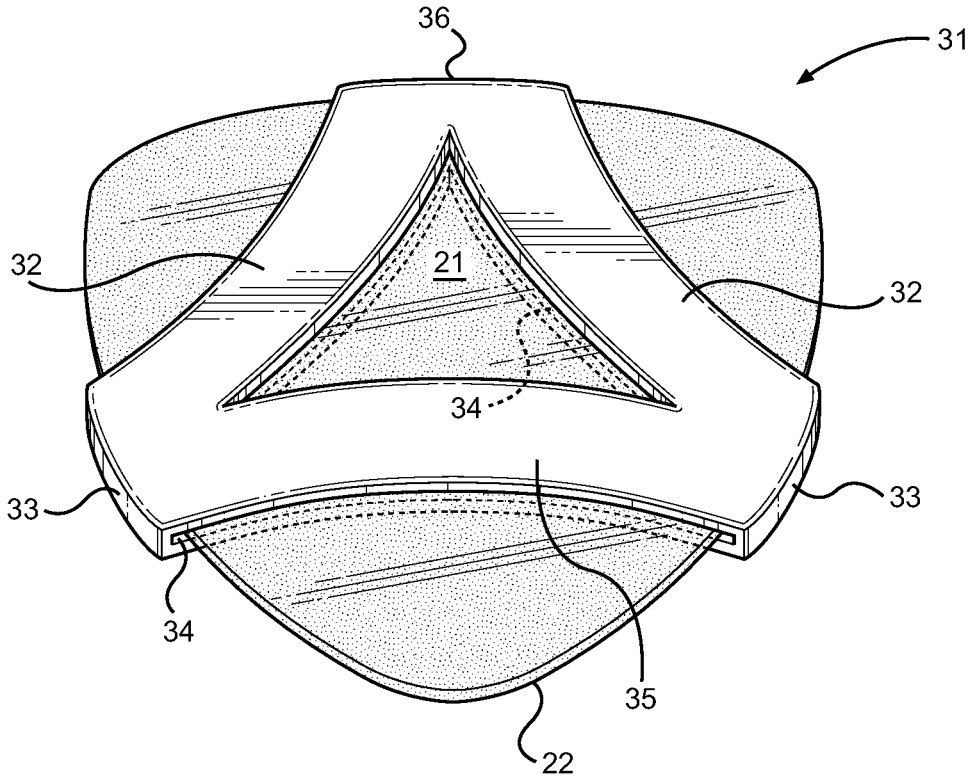
FIG. 3 shows a second embodiment of the pick cover of the present invention.

Referring now to FIG. 3, there is shown a view of an alternate embodiment 31 of the present invention, wherein the cover includes a triangular shape and cover less of the pick surface area. This embodiment 31 includes a first and second side portion 32 that connects to a bridge 35, whereby the side portions 32 and bridge 35 form a triangular shape over the upper and lower surfaces 21 of the pick but do not completely shroud its widened base. The plucking end 22 of the pick is exposed for use with an instrument, while the side portions 32 and bridge 35 provide a thickened cover over the pick. The triangular shape provides an open interior for contacting the pick surfaces 21.

Figure 4:
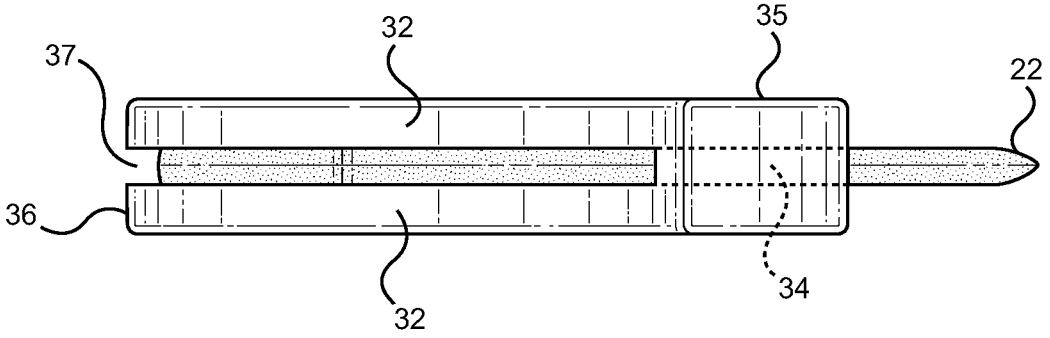
FIG. 4 shows a side view of the second embodiment of the present invention.

Within the body of the cover 31 is an elongated channel 34 that is adapted to accept the pick therein. Referring to FIG. 4, the pick body includes a base end 36 having a receiving slot 37 therethrough. The slot 37 allows the pick to be fitting into the channel 34 such that the side portions 32 and bridge portion 35 are positioned over the pick surfaces and the pick plucking end 22 is exposed outside of the cover.

A significant number of musicians prefer using a pick when playing their instrument. Conventional picks have smooth surfaces of variable thicknesses that can easily fall from the hand while in use, causing a major inconvenience to the musician. Picks also tend to move within the user's grip during a performance, which can interrupt the user and require him or to stop playing to reposition. Some musicians also complain that they lose the feeling in their fingertip because of the thinness of the pick. A device is needed that drastically reduces or eliminates these obstacles. The present invention describes a pick cover that addresses these known issues in the art of stringed instrument picks.

The present invention comprises a thickened cover that surrounds the pick and provides greater grip thereof. The device is comprised of a rubber, silicone, plastic, or foam material, wherein the device is thickened to increase the graspable area and to provide a cushioned structure over the pick. The device is available in a horseshoe-shaped and a triangle-shaped embodiment, ensuring that it can conform to any playing style. The cover can also glow-in-the-dark, which can add a visual element to a live performance. The present invention can be used by anyone who uses a pick to play a guitar, mandolin, or other similar instrument.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stringed instrument pick cover, comprising:

a thickened member comprising tapering side portions extending between a wide base and a bridge disposed at a narrow distal end;

an interior channel through said thickened member adapted to accept an instrument pick therein;

said channel having a progressively narrowing width adapted to accommodate a shape of the pick;

a receiving slot through said wide base connecting to said interior channel;

a distal end slot along said narrow distal end adapted to allow a pick plucking end to extend therethrough;

an open interior through said thickened member bounded by said side portions, wide base and said bridge.

2. The device of claim 1, wherein said thickened member includes a phosphorescent surface thereon.

3. A stringed instrument pick cover, comprising:

a thickened member comprising a first and second side portion and a bridge forming a substantially triangular shape with a base end and a distal end;

an interior channel through said thickened member adapted to accept an instrument pick therein;

a receiving slot through said base end connecting to said interior channel;

a distal end slot along said distal end adapted to allow a pick plucking end to extend therethrough;

an open interior through said thickened member bounded by said side portions, base end and said bridge.

4. The device of claim 3, wherein said thickened member includes a phosphorescent surface thereon.

5. The device of claim 1, wherein the side portions comprise a cylindrical shape.

6. The device of claim 1, further comprising phosphorescent decals disposed on the thickened member.

7. The device of claim 1, wherein the stringed instrument pick cover is adapted to leave the pick plucking end exposed for contact with a stringed instrument.

8. The device of claim 1, wherein the open interior is adapted to provide access to the instrument pick placed within the interior channel.

9. The device of claim 3, further comprising phosphorescent decals disposed on the thickened member.

10. The device of claim 3, wherein the stringed instrument pick cover is adapted to leave the pick plucking end exposed for contact with a stringed instrument.

11. The device of claim 3, wherein the open interior is adapted to provide access to the instrument pick placed within the interior channel.

* * * * *